United States Patent [19]

Kramer

[11] 4,290,334

[45] Sep. 22, 1981

[54] ELECTRONIC WAVE SHARING SYNTHETIC SOUND SYSTEM

[76] Inventor: Justin Kramer, 1028 W. Eighth Pl., Los Angeles, Calif. 90017

[21] Appl. No.: 171,106

[22] Filed: Jul. 22, 1980

[51] Int. Cl.[3] ..... G10H 1/057; G10H 5/02

[52] U.S. Cl. ..... 84/1.26; 84/1.11; 84/1.13; 84/1.19; 84/1.21

[58] Field of Search ..... 84/1.01, 1.11–1.13, 84/1.19–1.24, 1.26

[56] References Cited

U.S. PATENT DOCUMENTS

| | | | |
|---|---|---|---|
| 3,141,919 | 7/1964 | Mabuchi | 84/1.26 |
| 3,328,506 | 6/1967 | Park | 84/1.24 |
| 3,417,189 | 12/1968 | Kramer, Jr. | 84/1.19 |
| 3,480,718 | 11/1969 | Kohls et al. | 84/1.01 |
| 3,636,801 | 1/1972 | Ichikawa | 84/1.13 |
| 3,940,635 | 2/1976 | Meyer | 84/1.13 X |
| 3,971,283 | 7/1976 | Wayne, Jr. | 84/1.26 |
| 4,012,702 | 3/1977 | Weber | 84/1.13 X |
| 4,101,885 | 7/1978 | Blum | 84/1.01 X |
| 4,110,750 | 8/1978 | Heyning et al. | 84/1.01 X |
| 4,250,496 | 2/1981 | Southgate | 84/1.01 |

*Primary Examiner*—S. J. Witkowski

*Attorney, Agent, or Firm*—Vernon D. Beehler

[57] ABSTRACT

An electronic sound system especially effective with bell sounds synthesizes the approximate sound of each bell in a set of 49 switch operated bell sounds. The synthesizing is accomplished by utilizig an envelope generator for each partial of a group of 7 partials for each of the 49 sounds, in association with a single 73 note wave generator. The envelope generators for low partials of each group of 7 are slow attack, slow decay relatively long envelopes. The envelope generators for the high partials of the same group of 7 are fast attack, fast decay relatively short envelopes, and envelopes for certain intermediate partials are fast attack with combined short and long decay envelopes of intermediate length. There is a single wave generator for each of 73 tones, the wave generators having circuits interconnecting them with partials of common frequency of the various groups of 7 partials for the respective keys. There is a special resistor diode matrix for each key consisting of 9 resistors and corresponding diodes for the respective 7 partials. Two of the partials have compound envelopes. Then with the partials of common frequency being interconnected with wave generators of common frequency, the wave generator output is shared in a way such that when two keys are closed simultaneously and certain partials are of the same frequency, those certain frequencies are reproduced at increased output power making the resultant bell sound more realistic.

16 Claims, 15 Drawing Figures

HARMONICS OF C

PARTIALS OF C-CAST BELL

PARTIALS OF C-SYNTHETIC BELL

PARTIALS OF G-SYNTHETIC BELL

TYPE P

TYPE Q

TYPE R

LONG
SHORT
P
LOW C
LOW G
MIDDLE C
261.63 Hz
783.99 Hz
ENVELOPE GEN.
GATE
ENVELOPE GEN.
GATE
50
51
52
53
54
55
56
57
58
59
60
61
62
63
64
65
66
67
68
69
70
71
72
73
74
75
76

ELECTRONIC WAVE SHARING SYNTHETIC SOUND SYSTEM

Electronic instruments which produce sounds through synthesis have been available for some time. Some of the sounds which have been thus produced are more realistic than others. In most cases, the sound is produced by a series of oscillators operating at selected frequencies which correspond to the notes of the chromatic musical scale in different octaves and in some cases synthesis is achieved by selecting the frequencies for each keyboard note in relation to the natural harmonic series. Besides the combination of the harmonics which produce the timbre of the sound, consideration is given to the attack and decay of the sound when the key corresponding to the desired note is depressed or released.

In the case of carillons, which are made up of bell sounds, the tones of different frequency which are combined to produce the bell sound timbre differ to a degree from natural harmonics and have come to be designated as partials, the hum tone being designated as the first partial and others in the order of higher frequencies as second, third, fourth, etc. to a range of four or more octaves.

In circuits provided for the synthesizing of musical sounds it often happens that many oscillators of precisely the same frequency are used in the system, but wired separately to different parts of the system. In solid state electronics the advance has been such that oscillators are relatively inexpensive, as are also other components of the system such as necessary envelope generators, gates, resistors, diodes, etc., which are required to be used in great abundance. Even though such parts can often be reproduced inexpensively every part must be wired into the system by interconnecting wires or printed circuits, all of which add to the complexity of the system, and add inescapable as a consequence to the cost.

It is therefore among the objects of the invention to provide a new and improved electronic sound system where there need be but a single tone or wave generator for each frequency thereby to substantially minimize the number of components without at the same time impairing the performance of the system.

Another of the objects of the invention is to provide a new and improved electronic sound system especially advantageous for the production of bell sound instruments, wherein the number of envelope generators is greatly reduced to but one or two per keyboard key yet providing a separate envelope for each partial.

Still another object of the invention is to provide a new and improved electronic sound system of a character such that, despite the minimizing of the number of tone or wave generators to a number equal to one each for the full range of partials, provision is made for an increase in power when two or more sounds are sharing the same frequency in order to give the impression of two separate sound sources being activated.

Still further among the objects of the invention is to provide a new and improved electronic sound system where there is but a single tone or wave generator for each frequency arranged for an increase in power when two or more sounds are sharing the same frequency and which substantially minimizes the number of envelope generators and gates while at the same time producing bell sounds in a realistic fashion and at a cost substantially lower than the cost of the inferior systems heretofore available.

With these and other objects in view, the invention consists of the construction, arrangement, and combination of the various parts of the device serving as an example only of one or more embodiments of the invention, whereby the objects contemplated are attained, as hereinafter disclosed in the specification and drawings, and pointed out in the appended claims.

For a better understanding of the invention herein disclosed it will be helpful to keep in mind some of the more basic musical principles.

Figure 3:
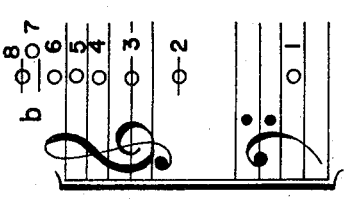
FIGS. 3,4,5 and 6 show the position of notes on the musical scale for sounds of different characteristics.

It is commonly understood that complex sounds are composed of an assortment of sine waves, frequently referred to as pure tones. In musical instruments the character of the sound which is the product of the combination of sine waves is referred to as timbre. Since waves are of different frequencies, high tones being of high frequency and lower tones being of lower frequency. When the frequencies of the individual sine waves of the sound or note are related to one another in the ratio of simple whole numbers the individual frequencies are referred to as harmonics. FIG. 3 shows in approximate musical notation the first eight harmonics for the note C. In bells and other percussive instruments, the frequencies of the individual sine waves are not always in the relationship of simple whole numbers. In the development of musical terminology they have come to be identified as partials.

Figure 4:
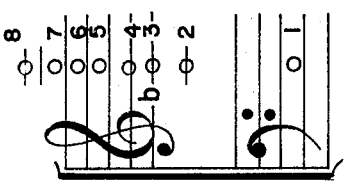

The approximate musical pitches of the first eight partials of a typical cast bell, note C, are shown in FIG. 4. It will be seen that except for partial number three which is a musical minor third above partial number two, the partials of a cast bell are closely related to the harmonic series based on simple whole number relationships shown in FIG. 3. It should be noted that bells typically have more partials than shown on FIG. 4. For an easier understanding of the principles involved the number is here limited to seven, and are so numbered in FIGS. 5 and 6, numbers are for synthetic sounds.

Figure 7:
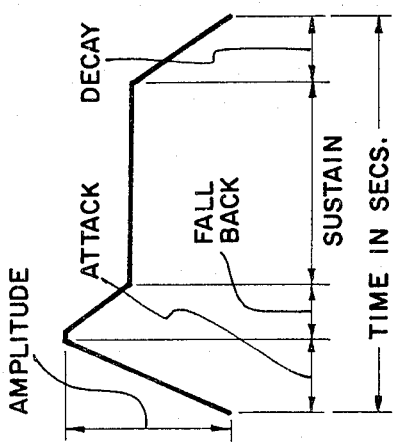
FIG. 7 shows the form of an envelope of sounds from conventional musical instruments.

Timbre is determined not only by the frequencies of the various harmonics or partials but also by their relative amplitudes. It should also be noted that timbre will vary for the duration of a sound. This variation is sometimes termed the envelope. By way of example only FIG. 7 illustrates the four basic portions of an envelope for sounds from instruments such as violin, trumpet, et cetera.

From left to right the successive portions of the envelope are called attack, fall-back, sustain, decay. Sounds of bells and percussive instruments are similar except that there is no period of sustain. During the time of attack, fall-back and decay, the timbre is constantly changing because each one of the partials has its own rate of attack and fall-back, and decay, or more properly its own envelope.

Figure 8:
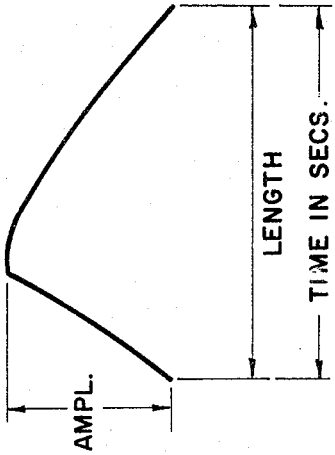
FIGS. 8,9 and 10 show the form of envelopes of bell sounds.
Figure 9:
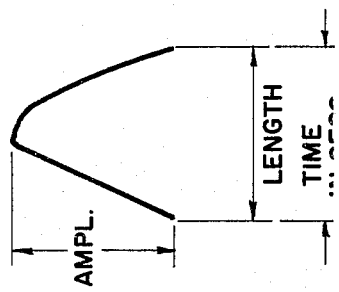
Figure 10:
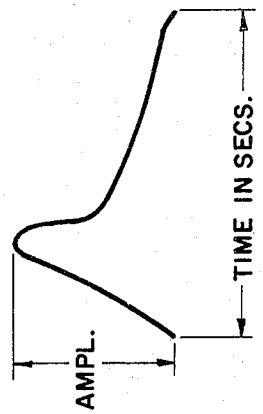

In general, most envelopes for bell partials fall into one of three types, see FIGS. 8,9 and 10. Type P may be described as slow attack, slow fall-back and decay, type Q as fast attack, fast fall-back and decay and type R as fast attack, fast fall-back and slow decay.

Referring to FIGS. 8,9 and 10 it should be noted that type P and Q envelopes will combine to produce a type R envelope. It might also be noted that if an envelope were devised which would be intermediate of type P and Q, i.e. with rise and fall times less than type P but greater than type Q, the possible envelopes available by using the three types singly and in combination would number eight.

In bells, the overall length of each of these types of envelopes is ordinarily related to frequency. It may be observed that a large bell whose fundamental frequency is lower than a small bell will ring longer than the small bell. Likewise the first partials of any bell i.e. lower tones, ring longer than the higher partials i.e. higher tones.

Figure 1:
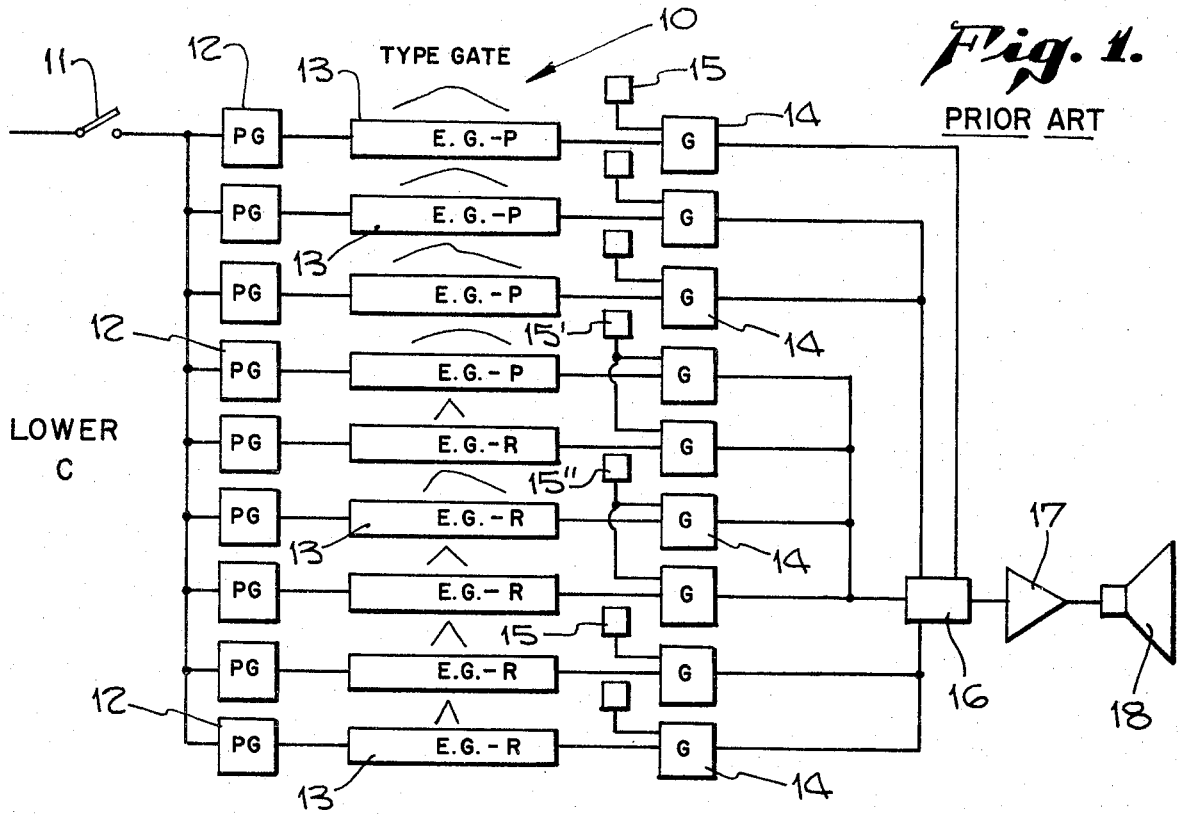
Fig. 1. PRIOR ART
FIG. 1 is a schematic drawing of a prior basic circuit for electronically produced synthetic sounds.
Figure 2:
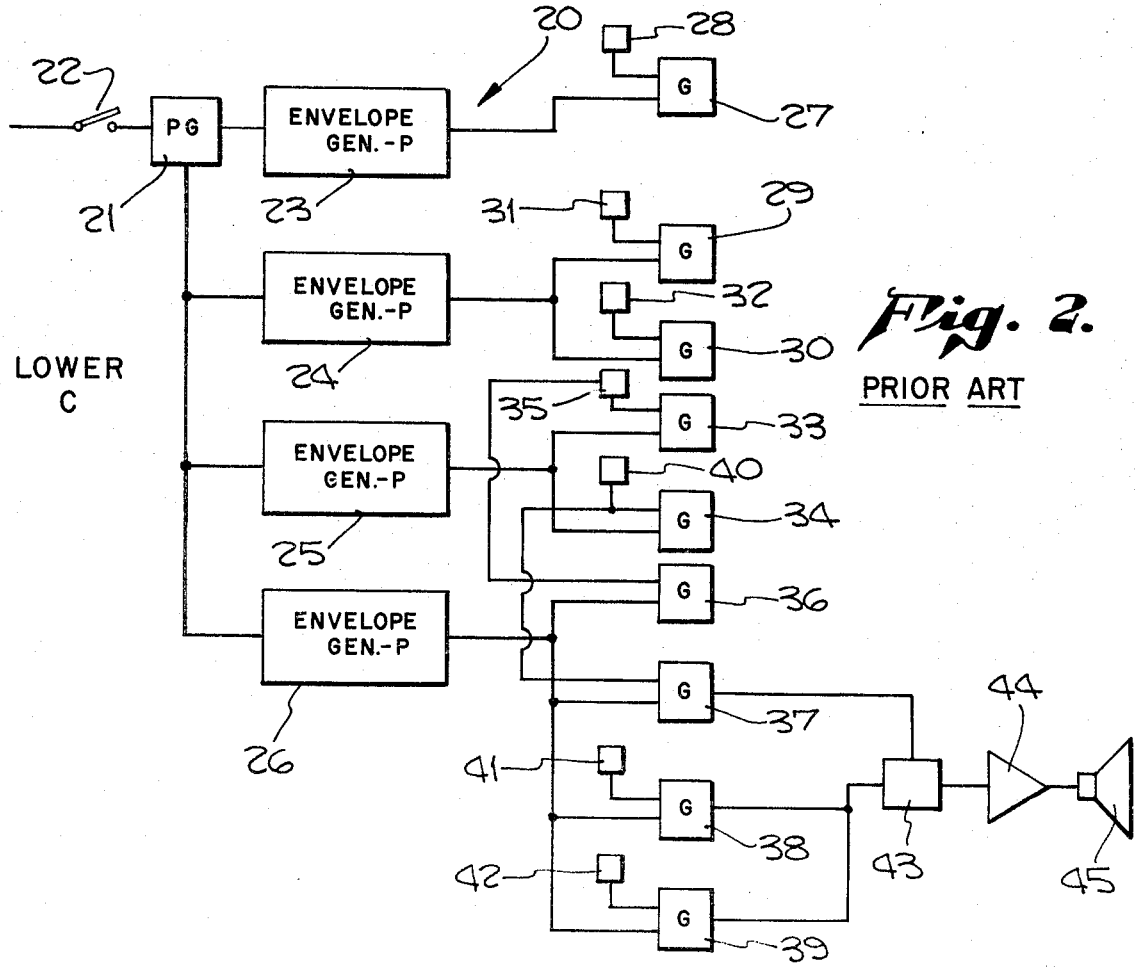
Fig. 2. PRIOR ART
FIG. 2 is a schematic drawing of a prior circuit wherein the functions of some components have been combined.

To understand the synthetic production of bell sounds by use of an electronic circuit it should be helpful to make reference to FIGS. 1 and 2. A substantially conventional schematic circuit 10 for sound production is shown in FIG. 1 for a single sound, as for example lower C on the musical scale. To activate the circuit a switch 11 is closed supplying a charge to each of nine pulse generators 12. Each pulse generator is connected to its own envelope generator 13 which in turn is connected to a separate gate 14.

In the example of FIG. 1 there are seven wave, or tone, generators 15. On the assumption that the three wave generators at one end are for low tones, the two wave generators at the other end for high tones, it can be assumed that the intermediate two generators are for intermediate tones.

On this premise the three envelope generators 13 at one end are for slow attack, slow decay, long envelopes and the two envelope generators 13 at the other end for fast attack, fast decay, short envelopes. The intermediate envelope generators 13 combine with the respective gates to provide for fast attack, fast fall-back and slow decay envelopes of intermediate length. Wave or tone generators 15' and 15'' each supply two of the gates 14 which serve the corresponding intermediate envelope generators.

All of the gates 14 communicate with a common filter set 16, amplifier 17 and loud speaker 18. For the purpose of cutting down to a degree the number of components some combining is possible, operative in a way not to unduly impair the quality and character of the sound ultimately produced at the loud speaker 18. This is at best a compromise.

FIG. 2 is a schematic diagram suggestive of such a circuit 20. In this circuit is a single pulse generator 21 energized by the closing of a switch 22. The pulse generator 21 in turn activates only four envelope generators 23, 24, 25 and 26, productive of envelopes differing one from another. In this example the envelope generator 23 at one end supplies a single gate 27 served in turn by a single wave or tone generator 28. Envelope generator 24 supplies two gates 29 and 30, each with its own wave generator, 31 and 32 respectively.

The envelope generator 25 supplies two gates 33 and 34, associated with respective wave generators 35 and 40. These two generators are shared with gates 36 and 37. Four gates 36, 37, 38 and 39 are supplied by the envelope generator 26. As has already been noted gates 36 and 37 share their wave generators with 35 and 40 while gates 38 and 39 have their own wave generators 41 and 42 respectively.

All of the gates interconnect with a common filter set 43, amplifier 46, and loud speaker 45. For the sake of simplicity only the connections between gates 37, 38, 39 and the filter set are shown on FIG. 2.

It can be demonstrated that an acceptable bell sound can in fact be synthesized electronically. The technique is to employ near sine waves having the musical relationships shown for the C bell of FIG. 5. This is a slight variation from the usual cast bell sound of FIG. 4. To synthetically produce a bell sound using these relationships seven wave or tone generators and seven envelope generators are required. In this example the low tones or partials have envelopes of one form, the high tones or partials have envelopes of another form and certain intermediate tones or partials have envelopes of still another form. These are the different envelope forms referred to in FIGS. 8, 9 and 10. In the chosen example the three lower tones or partials are of the form of FIG. 8, the two highest tones or partials have the form of FIG. 9 and the two intermediate tones or partials have the form of FIG. 10.

If a four-octave bell sound instrument were to be constructed using the method just described in FIG. 1, 343 tone generators plus 441 envelope generators to modulate the amplitudes of these tone generators would be required.

Under the circumstances frequencies of many of the tone generators would be the same. For example, the first partial of a bell in the second octave of the instrument would have the same frequency as the second partial of a bell whose first partial was one octave lower. It must be observed, however, that if both these notes were sounded together and the amplitude of the shared frequency were in both cases the same, the resultant sound power of the two bells for this shared frequency would be 100% more (3 dB) than it would be if only one bell were played.

In an embodiment of the invention herein described by way of illustration a four-octave polyphonic bell sound instrument has been selected. The instrument utilizes a minimum number of wave generators. The number of envelope generators is limited to 98. In this arrangement the number of wave generators is 73 for the reason that this is the number of keyboard notes between C=130.81 Hz and C=8372.02 Hz. It should be noted that tones above 8 KHZ do not contribute appreciably to bell sound and therefor in the synthesis of some of the high bell sounds not all seven partials are used.

The number of envelope generators is 98 for the reason that at least one envelope generator is required for each wave generator. In the keyboard range 25–49 two envelope generators are used for each key making an extra 25 envelope generators which when added to the 73 envelope generators makes 98 in all.

The range of the instrument is from C (130.91 Hz. for first partial) to C (2093 Hz. for first partial). The range of the wave or tone generators is from C=130.81 Hz to C=8372.02 Hz.

Figure 11:
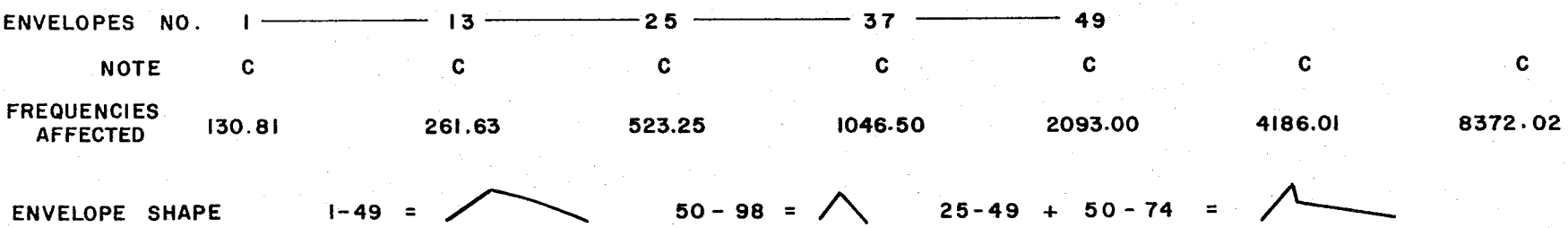
FIG. 11 is a table which relates the envelope shapes used in one form of the invention to the notes from C 130.8 Hz to C 8372.02 Hz.

The arrangement of the envelope generators relative to the frequencies of the tones they affect is graphically shown on FIG. 11. Envelope generators in the low frequency range 1–49 affect tones from 130.81 Hz. to 2093.00 Hz. Envelopes 1–49 in the low frequency range are like those of FIG. 8 which provide a relatively show attack and decay with number 1 having the longest overall envelope length and number 49 the shortest overall envelope length. Envelopes 50–98 in the high frequency range are like those of FIG. 9 which have a rather fast attack and fast decay. These also are graduated so the overall length of envelope number 98 is shorter than the overall length of number 50. For tones in the range 523.25 Hz.–2093.00 Hz. three envelopes are available, one from envelope generators 25–49, one from envelope generators 50–74 and the third by the combination of the two which is characterized by fast attack, fast fall-back, and slow decay, (see FIG. 10).

Figure 12:
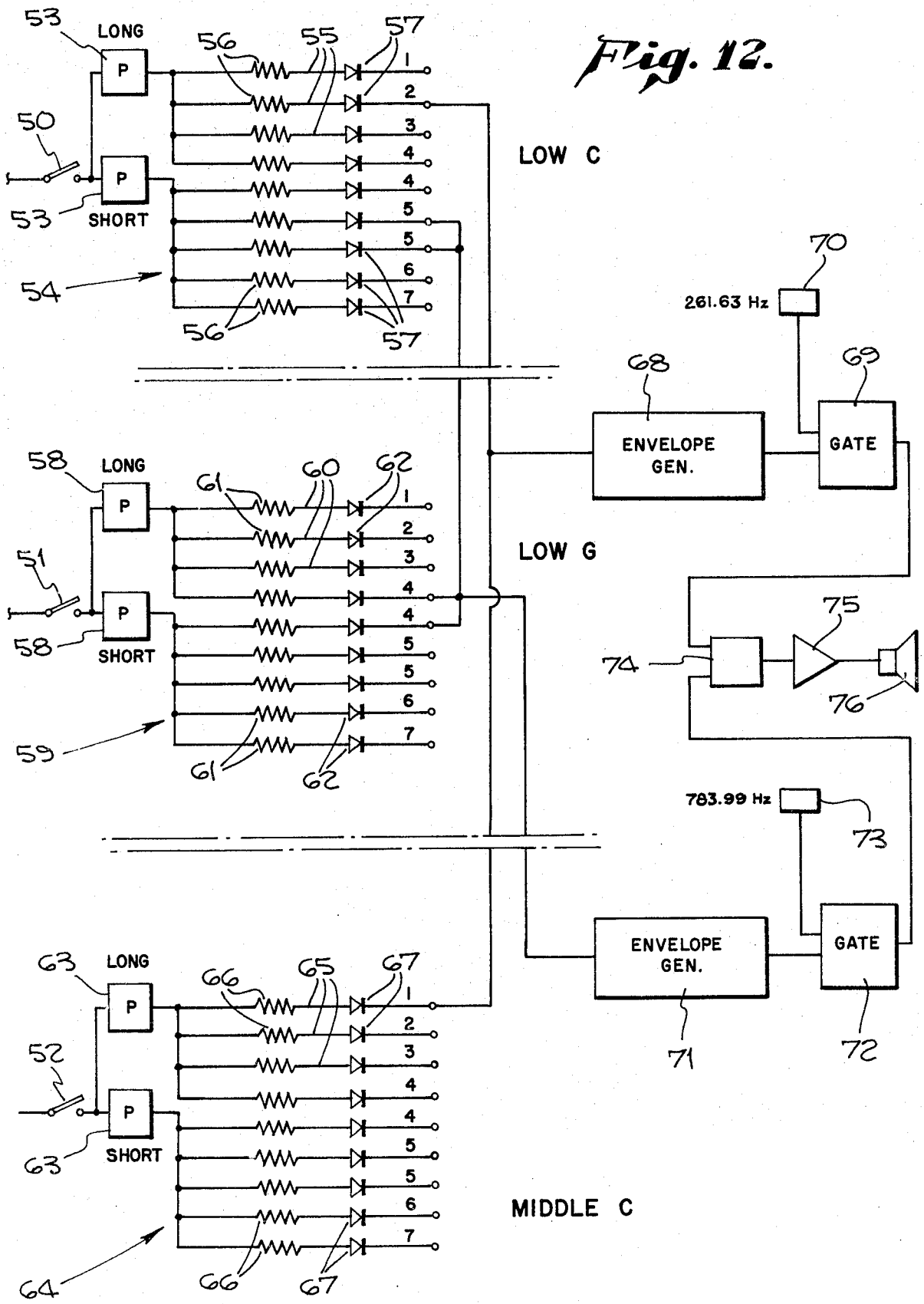
FIG. 12 is a partial schematic drawing showing an example of the combining of components of an electronic synthetic sound instrument including the invention.

Reference is now made to FIG. 12 as a partial, more detailed circuit embodying essentials of the disclosure. Merely by way of illustration the schematic includes sub-circuits for only low C, low G and middle C as being sufficient to suggest necessary interconnections permitting limiting the wave generators to a minimum of 73. Here also the envelope generators are limited in number to 98.

More particularly as shown in FIG. 12 there is a switch 50 for low C, a switch 51 for low G and a switch 52 for middle C. The switch 50 energizes pulse generators 53 which in turn supply electrical pulses of predetermined length to a group 54 of nine individual resistor diode combinations 55. In each of these is a resistor 56 connected in series with a diode 57. These accommodate seven partials of the note low C.

Similarily the switch 51 energizes pulse generators 58 which in turn supply electrical pulses of pre-determined length to a group 59 of nine individual resistor diode combinations 60. In each of these also is a resistor 61 and diode 62 in series. These nine resistor diode combinations accommodate seven partials of the note low G.

At an ocatve above the switch 50 for low C, is the switch 52 for middle C and its pulse generators 63. These supply a set 64 of nine individual resistor diode combinations 65, each with a resistor 66 and diode 67.

Figure 5:
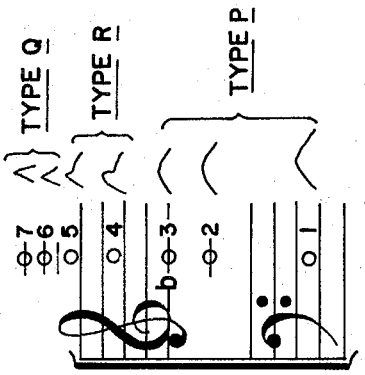

Having reference to FIG. 5 of the drawings it can be seen that partial No. 2 for low C is precisely the same note as partial No. 1 for middle C. Consequently these two partials are interconnected and supply a single envelope generator 68 which feeds into a gate 69. Cooperating with the gate 69 is a single wave generator 70 for a frequency of 261.63 Hz which is precisely the same for those partials. In this way the single wave generator serves a double purpose. The order of individual resistor diode combinations in a set is a matter of structural convenience.

Figure 6:
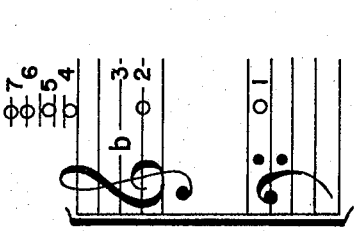

Similarly by way of example, and as seen in FIG. 6, partial No. 4 for low G is precisely the same note or tone as partial No. 5 for low C, see FIG. 5. These are interconnected as shown in FIG. 12 and supply a single envelope generator 71 and gate 72, the gate in turn being served by a wave generator 73 having the frequency 783.99 Hz of the two partials Nos. 4 of Note G and 5 of Note C.

From these examples it will be clear that there are a great many wave frequencies which are common to various switches throughout the four octaves of the keyboard having 49 keys. All of the gates are interconnected to a single filter set 74, amplifier 75 and speaker 76.

Figure 13:
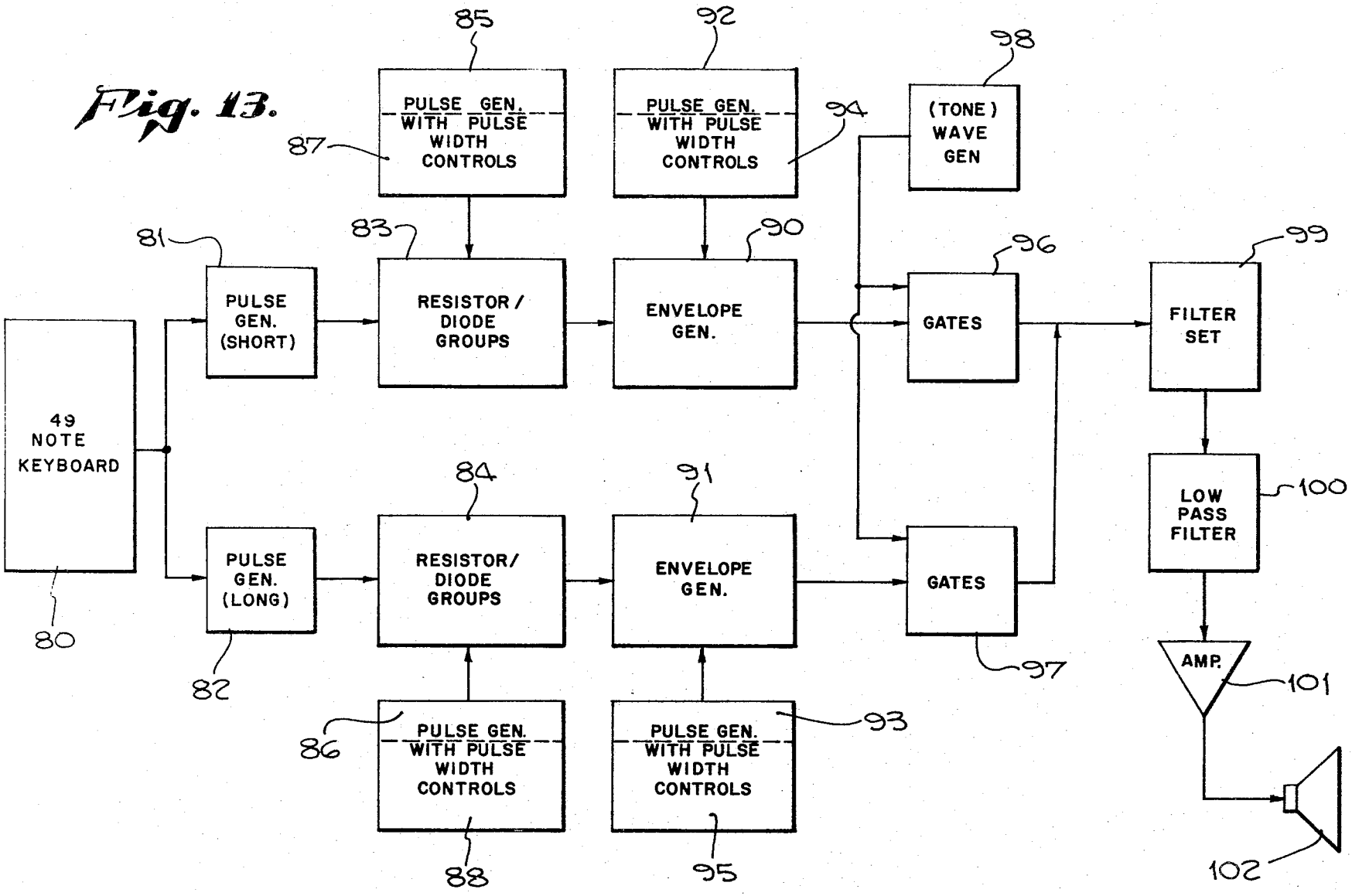
FIG. 13 is a box diagram showing an arrangement of components for all keys, envelope generators, wave generators and speaker equipment including the invention.

In carrying the disclosure one step further there is shown in FIG. 13 a block diagram of a 49-note instrument. Keyboard 80 is a conventional 49 note chromatic keyboard range C2-C6 with an electric switch, operated by each key like the switches 50, 51 and 52. The output from each switch is electrically connected to a pulse generator. In this example there are two groups of pulse generators 81 and 82 so that closing each switch energizes. two generators. These two generators each produce one electrical pulse of predetermined duration each time a key is depressed. The pulse produced by a generator in group 82 is longer than the pulse produced by a generator in group 81. The output of each pulse generator is fed to resistors, like the resistors 56, in series with their respective diodes, like the diodes 57, of FIG. 12 in resistor-diode groups 83 and 84. These are like those referred to in FIG. 12 as groups 54, 59 and 64. Associated with these resistor-diode groups 83 and 84 are pulse generators 85 and 86 whose pulse width is variable and adjustable through partial amplitude control 87 and 88. Pulse generators 85 and 86 can be used to vary the amplitude of any partial by reducing the effective duration of the pulse produced by pulse generators 81 and 82. One method is shown on FIG. 14. Here it will be seen that if buss 116 is connected to ground a positive pulse from pulse generator 81' will not be able to switch transistor 111. On the other hand if buss 116 is connected to ground during only half the duration of a positive pulse from pulse generator 81' transistor 111 will be switched on for half the duration of the pulse. The output of each resistor-diode group is connected to the input of a single envelope generator in groups 90 and 91. These are comparable to the envelope generators 68 and 71 of FIG. 12. Associated with these envelope generators are pulse generators 92 and 93 whose effective pulse width is variable and adjustable by respective pulse width controls 94 and 95 which control the rate of decay.

Referring again to FIG. 14, it will be noted that the amplitude of the envelope voltage is determined by the charge on capacitor 118. This capacitor will discharge through the Z input of gate 126. The duration of the period of discharge is therefor the duration or time of the decay. If resistor 127 is connected to ground potential through diode 128 the time of decay will be shortened, if the buss 129 is connected to a square wave generator referenced to ground potential, the effective value of resistor 127 will be twice its true value. Therefor the duty cycle of a pulsing ground connection to buss 129 will change the effective value of resistor 127 and therefor the decay time of the envelope. The output of each envelope generator controls one or the other of the two groups of gates 96 and 97.

Figure 15:
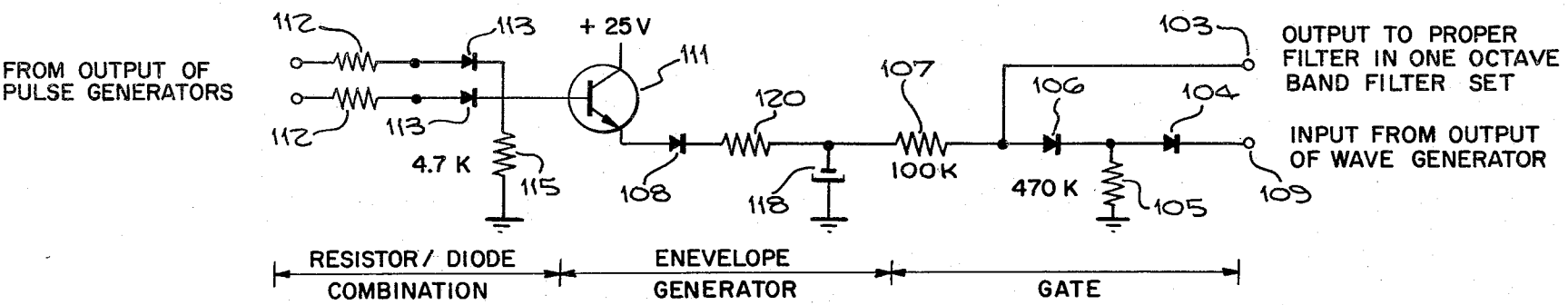
FIG. 15 is a schematic showing one type of arrangement for envelope generator and gate as might be used in the invention.

One form of gate is shown in FIG. 15. The resistor diode combination and envelope generator is shown the same as in FIG. 14 except that diode 108 has been added to prevent the possible zener breakdown of the transistor 111 and the discharge of capacitor 118 through it. In the circuit shown one end of capacitor 118 is connected to one lead of resistor 107 which forms one input of the gate. The other lead of resistor 107 is connected to the anode of diode 106 and to an input of a filter set through connection 103. The output from a square wave generator referenced to ground potential is connected to input point 109. During the times that point 109 is at ground potential, the voltage at 103 will be low (near ground potential) when the voltage at point 109 goes high, e.g. to +24 volts, the voltage at point 103 will go high, i.e. to the voltage applied to resistor 107 by capacitor 118 and divided by the network of resistor 107 diode 106 and resistor 105. In this way the frequency of the square wave applied at 109 will be reflected at point 103 but at an amplitude proportional to the voltage of the charge on capacitor 118. This is shown as one form which gates 96 and 97 may take however these gates can be any of a number of conventional types such as four quandrant multipliers, voltage controlled amplifiers, et cetera.

Each gate controls the output of one frequency in a wave generator 98. If the output from the wave generator is other than sine wave, e.g. square wave, the output from each gate is then fed to a suitable low pass filter in filter set 99 having a cutoff frequency such that the signal from the gate will be modified to the desired form. The output from the filter set 99 is then fed to a 3 dB per octave low pass filter 100 for balance between low and high frequencies. This arrangement is especially effective for reduction in system noise, and extends the value of the arrangement of resistor diode combinations. The output from this last identified filter is then fed to a power amplifier 101 which in turn provides power to a loudspeaker 102.

Figure 14:
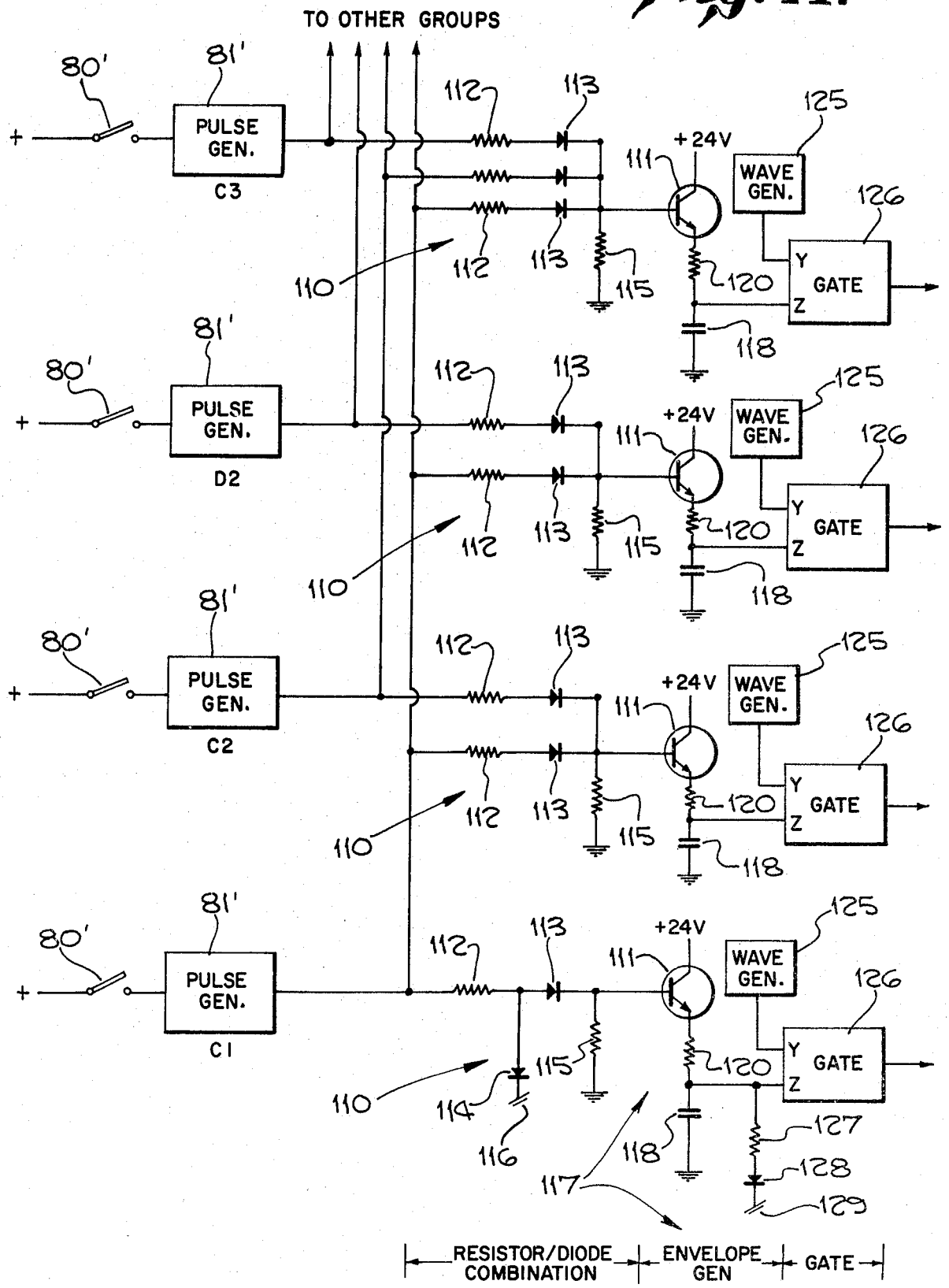
FIG. 14 is a partial schematic representation of the interconnection of four keyboard notes with four wave generators illustrating one method of sharing described in the invention.

FIG. 14 shows the typical electrical control path for single partials from a specific keyboard key to a corresponding gate. Having reference for example the lowermost portion of the diagram in FIG. 14 each resistor-diode combinations of group 110 is shown in greater detail than corresponding resistor-diode combinations of groups 55, for example, of FIG. 12. Each time a key switch 80' is closed, a pulse generator 81' is energized and will supply a single pulse to all of the resistor-diode combinations proper to the note. In the schematic of FIG. 14 where single pulse generators are shown for clarity in description this pulse will be applied to the base of a transistor 111 through a resistor 112, diode 113 in association with a diode 114 and with a resistor 115, the diode 114 being connected to a partial amplitude control buss 116. One connection of the resister 115 is to the resistor diode combination(s), on the cathode side of diode(s) 113 opposite from the resistor 112, whether there be one or more diodes (see FIG. 14). The other connection of the resistor 115 is to ground.

Should the diode 114 be removed and the circuit be isolated, then resistor 112 and resistor 115 will act as a simple voltage divider and the voltage applied to the base of the transistor 111 will be some fraction of the pulse voltage. For example if both resistor 112 and resistor 115 are of the same value, the voltage at the base of the transistor 111 will be approximately half of the pulse voltage.

The output from the resistor-diode group 110 is tied to the input of a relatively detailed envelope generator 117, which was previously identified as contained in the block diagram of FIG. 13. A capacitor 118 in the emitter follower circuit of the transistor 111 is charged through the resistor120 for the duration of the pulse applied to the base of transistor 111. As the charge of the capacitor 118 increases the voltage at the Z input terminal of Gate 126 increases, increasing the voltage of the signal at the output of the gate. This provides for the attack portion of the envelope. When the pulse stops, voltage of the signal at the output of a gate 126 gradually decreases as capacitor 118 discharges. This produces the decay portion of the envelope. If it is desired to have a variable decay, this can be done by discharging capacitor 118 through a resistor 127 and diode 128 which are connected to a buss 129 which in turn is switched to ground by a variable width pulse generator (not shown). In an instrument having fixed decay rates, resistors 127, diodes 128 the associated busses 129 and variable width pulse generators are omitted.

The presence of the diode 114 in communication with the partial amplitude control buss 116 and its connection to a pulse generator in the circuit is optional. This connection to a pulse generator having a variable pulse width to ground is merely a means of shortening the effective duration of the pulse and therefore the charging time of the capacitor 118. If one pulse generator as exemplified by 85 and 86 of FIG. 13 is provided for each group of resistor diode combinations for a specific partial number, then the timbre of the bell sound is completely adjustable. If a fixed timbre is desired, all diodes 114 with their associated pulse generators are not required and the strength of each partial is adjusted by selecting a fixed resistor for the resistor 112.

The relative values of all 112 and 115 resistors are very important to the success of the invention, not only for the adjustment of the timbre of each bell, but for the proper sound when two bells with partials sharing the same frequency are played together. This has already been touched on in the description of FIG. 12. For example, if two bells whose fundamental frequencies herein referred to as first partials, are one octave apart and are played simultaneously, the second partial of the lower bell will have the same frequency as the first partial of the higher bell. Assuming that the two bells are played simultaneously and the first and second partials of both bells are of the same sound power, the sound of the frequency which is shared should be produced by the loudspeaker at a power which is two times that if the frequency was unique to only one bell. The accepted relationship for two times the power is 3 dB meaning three decibels. FIG. 14 shows the equivalent circuit for the summing which would occur when two partials having the same amplitude and frequency are generated by sounding two bells together. From FIG. 14 it can be shown that when a pulse is applied to two diode groups 110 from the closing of two switches simultaneously the voltage applied to the base of the transistor 111 in each case, in the envelope generator 117, will be approximately 3 dB greater than when a pulse is applied to either one of the inputs of the resistor-diode groups 110 taken singly provided that the resistor values are properly selected, e.g. resistor 112=12,000 ohms resistor 115=8,200 ohms. This eliminates the problem of over adding which occurs when two coherent voltages are added (i.e. 6 dB gain).

Moreover while in the description given each envelope generator is described as controlling one gate, it is possible to reduce the number of gates required by having envelopes affecting the same frequency affect the same gate. In the given illustration this would reduce the number of gates required to 73 instead of 98.

Having described my invention, what I claim and seek to secure by Letters Patent is:

1. In a system for synthetically producing realistic musical bell sounds by electronic means including a keyboard switch member for each bell sound to be produced wherein each bell sound has a plurality of partials, pulse generators corresponding to the respective switch members, a plurality of electronic gates for the respective switch members feeding a speaker, and an envelope generator for each partial of each said sound electrically interconnected between the pulse generator and the respective gate, the combination of a wave generator for each partial having an electric connection to the corresponding gate, and a resistor diode pair for each partial making up a plurality of groups of resistor-diode combinations for each said sound, each resistor-diode combination comprising a resistor and diode in series and electrically connected between the respective pulse generator and the respective envelope generator, there being electric connections between each envelope generator and those of said individual resistor-diode combinations which serve partials of corresponding frequency, and an electric connection between each wave generator of frequency corresponding to the gate and envelope served by resistor-diode combinations for partials of corresponding frequency.

2. A system as in claim 1 wherein there are four octaves of keyboard switch members, seventy-three tone generators and ninety-eight envelope generators.

3. A system as in claim 1 wherein there is a pair of pulse generators and corresponding envelope generators electrically connected to at least some of the keyboard switch members.

4. A system as in claim 3 wherein there is a gate for each pulse generator and corresponding envelope generator.

5. A system as in claims 1 or 3 wherein there is a pulse width control for each of the groups of resistor-diode combinations which serve a respective pulse generator.

6. A system as in claim 3 wherein there is a group of resistor-diode combinations, an envelope generator and a gate for each pulse generator of said pair of pulse generators, a pulse width control for each group of resistor-diode combinations and envelope generator and a single wave generator electrically connected to both gates.

7. A system as in claim 3 wherein there is a second diode between each resistor and the respective pulse width control.

8. A system as in claim 3 wherein there is a supplemental diode between each envelope generator and the respective pulse width control.

9. A system as in claim 1 wherein each resistor-diode combination comprises a resistor and diode pair in series with the resistor having a connection on one side of the diode and a second resistor having a first connection to the circuit on the other side of the diode and a second connection to ground.

10. A system as in claim 9 wherein the resistors have different values.

11. A system as in claim 10 wherein there are a plurality of resistor and diode pairs and a single second resistor having a first connection to both of said diodes.

12. A system as in claim 1 wherein each resistor diode combination comprises a first resistor and diode pair in series with the resistor having a connection on one side of the diode, a second resistor and diode pair in series with one connection to the first resistor and diode pair at a location intermediate the resistor and the diode.

13. A system as in claim 12 wherein there is a third resistor having a first connection to the resistor-diode combination at the other side of the diode of the first resistor diode pair.

14. A system as in claims 1 or 9 wherein there is a filter set in series between the gates and the speaker and a low pass filter in series between the filter set and the speaker.

15. A system as in claim 14 wherein the low pass filter is a 3 dB per octave filter.

16. A system as in claim 1 wherein long generator envelopes are served by relatively long pulses and short generator envelopes are served by relatively short pulses.

* * * * *